US011015470B2

(12) United States Patent
Saraswathi et al.

(10) Patent No.: US 11,015,470 B2
(45) Date of Patent: May 25, 2021

(54) DIFFUSER FLEX SEAL ASSEMBLY

(71) Applicant: General Electric Company, Schenectady, NY (US)

(72) Inventors: Rajesh Prabhakaran Saraswathi, Bangalore (IN); Sankara Subramanian Kalanithi, Bengaluru (IN)

(73) Assignee: General Electric Company, Schenectady, NY (US)

( * ) Notice: Subject to any disclaimer, the term of this patent is extended or adjusted under 35 U.S.C. 154(b) by 118 days.

(21) Appl. No.: 16/157,661

(22) Filed: Oct. 11, 2018

(65) Prior Publication Data

US 2020/0116038 A1 Apr. 16, 2020

(51) Int. Cl.

| | |
|---|---|
| ***F01D 11/00*** | (2006.01) |
| ***F01D 9/00*** | (2006.01) |
| ***F01D 25/14*** | (2006.01) |
| ***F01D 25/28*** | (2006.01) |
| ***F01D 25/32*** | (2006.01) |

(52) U.S. Cl.

CPC ..... *F01D 11/003* (2013.01); *F01D 9/00* (2013.01); *F01D 25/145* (2013.01); *F01D 25/28* (2013.01); *F01D 25/32* (2013.01); *F05D 2220/3215* (2013.01); *F05D 2230/60* (2013.01); *F05D 2240/55* (2013.01); *F05D 2260/20* (2013.01)

(58) Field of Classification Search

CPC . F02C 7/28; F01D 9/023; F01D 25/30; F01D 25/24; F01D 9/045; F01D 25/243; F01D 25/26; F01D 11/003; F01D 9/00

USPC ..... 415/138

See application file for complete search history.

(56) References Cited

U.S. PATENT DOCUMENTS

| | | | | |
|---|---|---|---|---|
| 6,065,756 | A | 5/2000 | Eignor et al. | |
| 6,807,803 | B2 * | 10/2004 | Poccia | F02K 1/822 60/39.5 |
| 7,527,469 | B2 * | 5/2009 | Zborovsky | F01D 9/041 277/412 |
| 7,793,507 | B2 | 9/2010 | Poccia et al. | |
| 8,671,536 | B2 * | 3/2014 | Spanos | F01D 25/285 29/281.1 |
| 2002/0163134 | A1 * | 11/2002 | Cromer | F16J 15/3288 277/411 |
| 2008/0060362 | A1 | 3/2008 | Poccia et al. | |
| 2015/0040393 | A1 * | 2/2015 | Shteyman | F01D 25/30 29/888.02 |

* cited by examiner

*Primary Examiner* — Courtney D Heinle
*Assistant Examiner* — Andrew Thanh Bui
(74) *Attorney, Agent, or Firm* — Fletcher Yoder, P.C.

(57) ABSTRACT

A flex seal assembly includes a plurality of duct segments configured to be disposed about a joint between a turbine of a turbine system and a diffuser of the turbine system. The plurality of duct segments includes a groove configured to extend circumferentially around the joint. Additionally, the plurality of duct segments includes a first duct segment of the plurality of duct segments and a second duct segment of the plurality of duct segments. The second duct segment includes a drain. Furthermore, the plurality of duct segments include insulation disposed within the groove of the plurality of duct segments.

18 Claims, 8 Drawing Sheets

DIFFUSER FLEX SEAL ASSEMBLY

BACKGROUND OF THE INVENTION

The subject matter disclosed herein relates to gas turbine systems, and, more particularly, to a flex seal assembly for a diffuser section of a gas turbine.

Gas turbine systems generally include a compressor, a combustor, and a turbine. The compressor compresses an airflow from an air intake and directs the compressed airflow to the combustor. The combustor combusts a mixture of the compressed airflow and fuel to produce hot combustion gases directed to the turbine to produce work, such as to drive an electrical generator or another load. The combustion gases produced by the turbine may be directed to a diffuser section downstream of the turbine of the gas turbine system.

Traditional diffuser sections of the gas turbine system are subject to high stresses due to the configuration of the diffuser section and high temperatures associated with the combustion gases. Accordingly, traditional diffuser sections may experience high stresses from thermal expansion and contraction.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a flex seal assembly includes a plurality of duct segments configured to be disposed about a joint between a turbine of a turbine system and a diffuser of the turbine system. The plurality of duct segments includes a groove configured to extend circumferentially around the joint. Additionally, the plurality of duct segments includes a first duct segment of the plurality of duct segments and a second duct segment of the plurality of duct segments. The second duct segment includes a drain. Furthermore, the plurality of duct segments include insulation disposed within the groove of the plurality of duct segments.

In a second embodiment, a system includes a turbine, a diffuser configured to receive an airflow from the turbine, and a flex seal assembly. The flex seal assembly includes a plurality of duct segments configured to be disposed about a joint between the turbine and the diffuser, and the plurality of duct segments is configured to enclose the joint and at least an end portion of the turbine. The plurality of duct segments includes a first duct segment of the plurality of duct segments, a second duct segment of the plurality of duct segments that includes a drain, and insulation disposed within each of the plurality of duct segments.

In a third embodiment, a method includes arranging a plurality of duct segments around a joint of a turbine system between a turbine and a diffuser of the turbine system. A first duct segment of the plurality of duct segments is arranged proximate to a bottom of the joint, and the first duct segment includes a drain and is different than other duct segments of the plurality of duct segments. The method also includes coupling the first duct segment of the plurality of duct segments to the diffuser of the turbine system proximate to the bottom of the joint, coupling a flex seal to the plurality of duct segments, and coupling the other duct segments of the plurality of duct segments to the diffuser and the first duct segment of the plurality duct segments.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Gas turbine systems expand combustion gases through turbines to produce work that may drive one or more loads. Some gas turbine systems may be used in combined cycle and/or cogeneration systems that produce work from the heat of the combustion gases, such as through generating steam and directing the steam to a steam turbine. A gas turbine system may be selected to drive a design load of a known size, however, the actual load on the gas turbine system may change during operation of the gas turbine system.

As a gas turbine system operates, combustion gases may flow from a turbine to a diffuser. The systems and methods described in detail below describe various embodiments of a retrofittable flex seal assembly that is configured to circumferentially surround a portion of a diffuser and provide a drain for liquid (e.g., water) that may collect between an outlet of the turbine and an inlet of the diffuser. In particular, the flex seal assembly may include a flex seal that interfaces with the diffuser and turbine. The flex seal assembly may also include several duct segments that surround the flex seal. The duct segments may be coupled to one another to form a duct assembly that may extend circumferentially around portions of the turbine and the diffuser. Moreover, at least one of the duct segments includes a drain.

Figure 1:
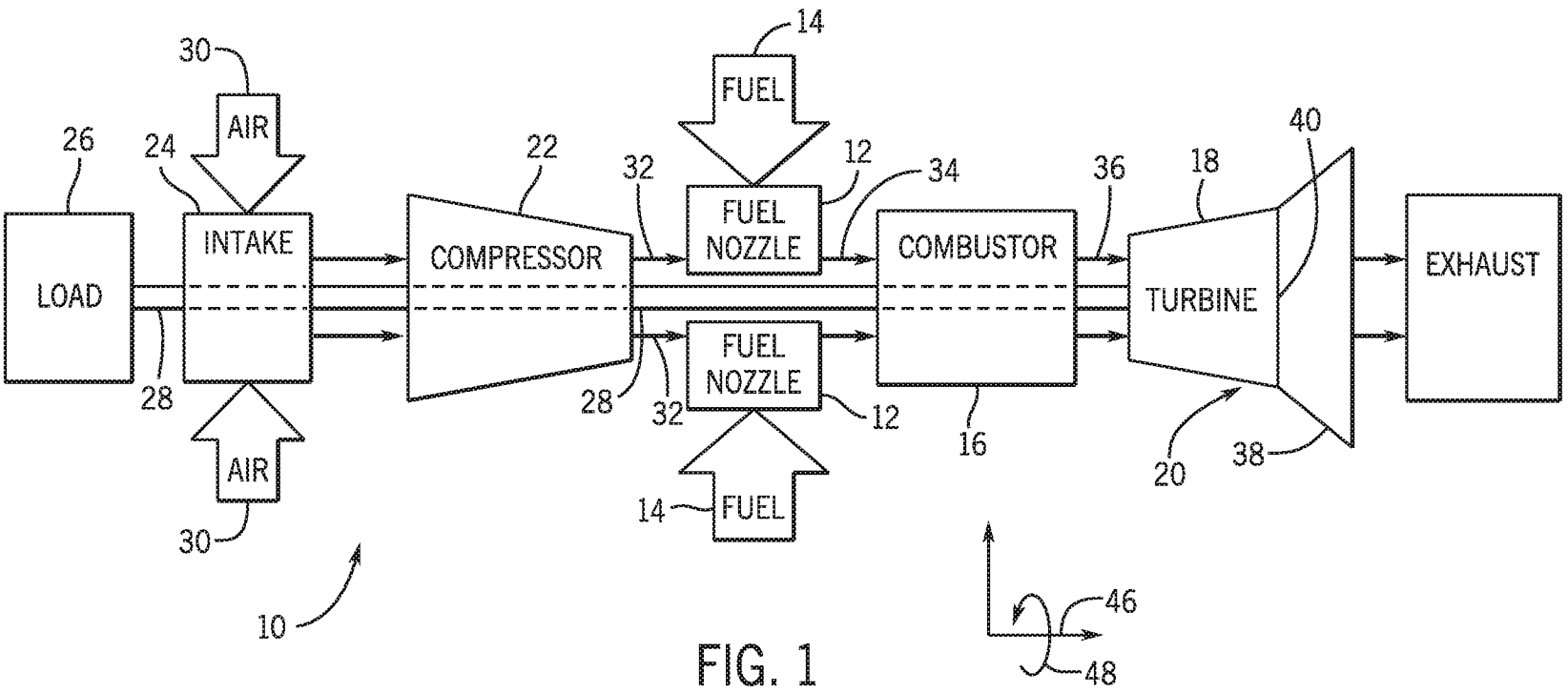
FIG. 1 is a schematic block diagram of an embodiment of a gas turbine system having a flex seal assembly for a diffuser section of a gas turbine.

Turning now to the drawings and referring first to FIG. 1, a block diagram of an embodiment of a gas turbine system 10 is illustrated. The diagram includes a fuel nozzle 12, fuel 14, and a combustor 16. As depicted, fuel 14 (e.g., a liquid fuel and/or gas fuel, such as natural gas) is routed to the turbine system 10 through the fuel nozzle 12 into the combustor 16. The combustor 16 ignites and combusts the air-fuel mixture 34, and then passes hot pressurized exhaust gas 36 into a turbine 18. The exhaust gas 36 passes through turbine blades of a turbine rotor in the turbine 18, thereby driving the turbine 18 to rotate about the shaft 28, which is coupled to several other components (e.g., compressor 22, load 26) throughout the turbine system 10. In an embodiment, a diffuser 38 is coupled to the turbine 18, and a retrofittable flex seal assembly 40 may be included at least partially between the diffuser 38 and the turbine 18. As discussed in detail below, the flex seal assembly 40 includes include certain structures and components that improve the reliability associated with the diffuser 38 (e.g., by reducing stress). For instance, the flex seal assembly 40 may include a flex seal disposed axially (e.g., along axis 46) between the turbine 18 and the diffuser 38; the flex seal assembly 40 may also include several duct segments that extend in a circumferential direction 48 around the flex seal. The diffuser 38 is configured to receive the exhaust gases 36 from the turbine 18 during operation. The exhaust gas 36 of the combustion process may exit the turbine system 10 via the diffuser 38 and the exhaust outlet 20. The flex seal assembly 40 is configured to enable relative movement in the axial direction 46 between the turbine 18 and the diffuser 38 due to thermal expansion and contraction while retaining the pressurized exhaust gas 36 within the turbine 18 and the diffuser 38.

In an embodiment of the turbine system 10, compressor vanes or blades are included as components of the compressor 22. Blades within the compressor 22 may be coupled to the shaft 28 by a compressor rotor, and will rotate as the shaft 28 is driven by the turbine 18. The compressor 22 may intake oxidant 30 (e.g., air) to the turbine system 10 via an air intake 24. Further, the shaft 28 may be coupled to the load 26, which may be powered via rotation of the shaft 28. As appreciated, the load 26 may be any suitable device that may generate power via the rotational output of the turbine system 10, such as a power generation plant or an external mechanical load. For example, the load 26 may include an external mechanical load such as an electrical generator. The air intake 24 draws the oxidant 30 (e.g., air) into the turbine system 10 via a suitable mechanism, such as a cold air intake, for subsequent mixture of air 30 with fuel 14 via the fuel nozzle 12. The oxidant 30 (e.g., air) taken in by turbine system 10 may be fed and compressed into pressurized air 32 by rotating blades within compressor 22. The pressurized air 32 may then be fed into one or more fuel nozzles 12. The fuel nozzles 12 may then mix the pressurized air 32 and fuel 14, to produce a suitable air-fuel mixture 34 for combustion.

Figure 2:
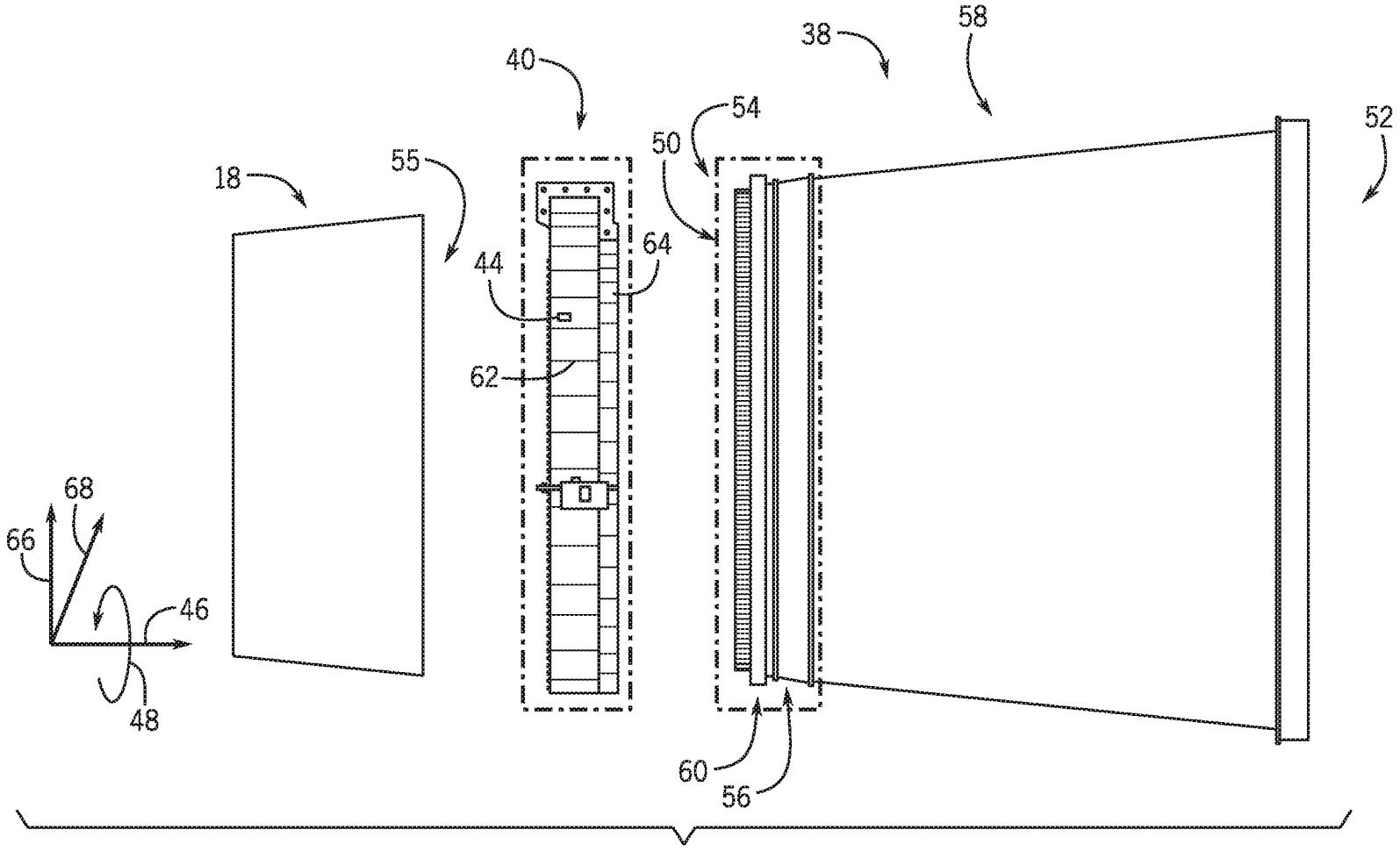
FIG. 2 is a side view of an embodiment of the flex seal assembly and an embodiment of the diffuser of FIG. 1.

FIG. 2 illustrates a side view of an embodiment of the flex seal assembly 40 and the diffuser 38 of the gas turbine system 10. As described above, the diffuser 38 may receive exhaust gases 36 from the turbine 18 before expelling the exhaust gases (e.g., as exhaust). For example, as illustrated, the diffuser 38 includes an inlet portion 50 that receives the exhaust gases 36 from the turbine 18 and an outlet portion 52 via which the exhaust gases 36 exit the diffuser 38. Also illustrated is a joint 54, which is downstream of the turbine 18 relative to the flow of the exhaust gases 36. In particular, the joint 54 defines an interface or space between the inlet portion 50 of the diffuser 38 and an outlet portion 55 of the turbine 18 from which the exhaust gas 36 may be expelled. The inlet portion 50 includes a neck portion 56 that is annular is shape and positioned axially between a body 58 of the diffuser 38 and a seal portion 60 of the inlet portion 50. The seal portion 60, which is also generally annular in shape, has a circumference that is larger than that of the neck portion 56. In some embodiments, the seal portion 60 may be a component separate from the inlet portion 50 of the diffuser 38. Additionally, the seal portion 60 may be included between the turbine 18 and the diffuser 38 to provide a seal between the turbine 18 and the diffuser 38. During operation, including startup or shutdown, of the turbine system 10, temperatures of the turbine 18 and diffuser 38 increase and decrease, thereby causing thermal expansion and contraction of portions of the turbine 18 and the diffuser 38. For instance, during startup and operation of the turbine system 10, at least a portion of the diffuser 38 may expand in the axial direction 46 toward the turbine 18 or at least a portion of the turbine 18 may expand in the axial direction 46 toward the diffuser 38, thereby reducing an axial width of the joint 54 between the turbine 18 and the diffuser 38. Shutdown of the turbine system 10 may cool the diffuser 38 and contract at least a portion of the diffuser 38 in the axial direction 46 away from the turbine 18. Similarly, shutdown of the turbine system 10 may cool the turbine 18 and contract at least a portion of the turbine 18 in the axial direction 46 away from the diffuser 38. As described below, the flex seal assembly 40 may accommodate axial movement (e.g., movement long the axis 46) of the turbine 18 with regard to the diffuser 38 while isolating the exhaust gases 36 from an environment in which the turbine system 10 is located. Moreover, changes in temperature may cause portions of the flex seal assembly 40 to thermally expand and contract. Insulation may be arranged within the flex seal assembly 40 to control the thermal expansion and contraction of interior portions of the flex seal assembly 40 while maintaining the temperature of exterior portions of the flex seal assembly 40 below a desired threshold temperature.

Figure 4:
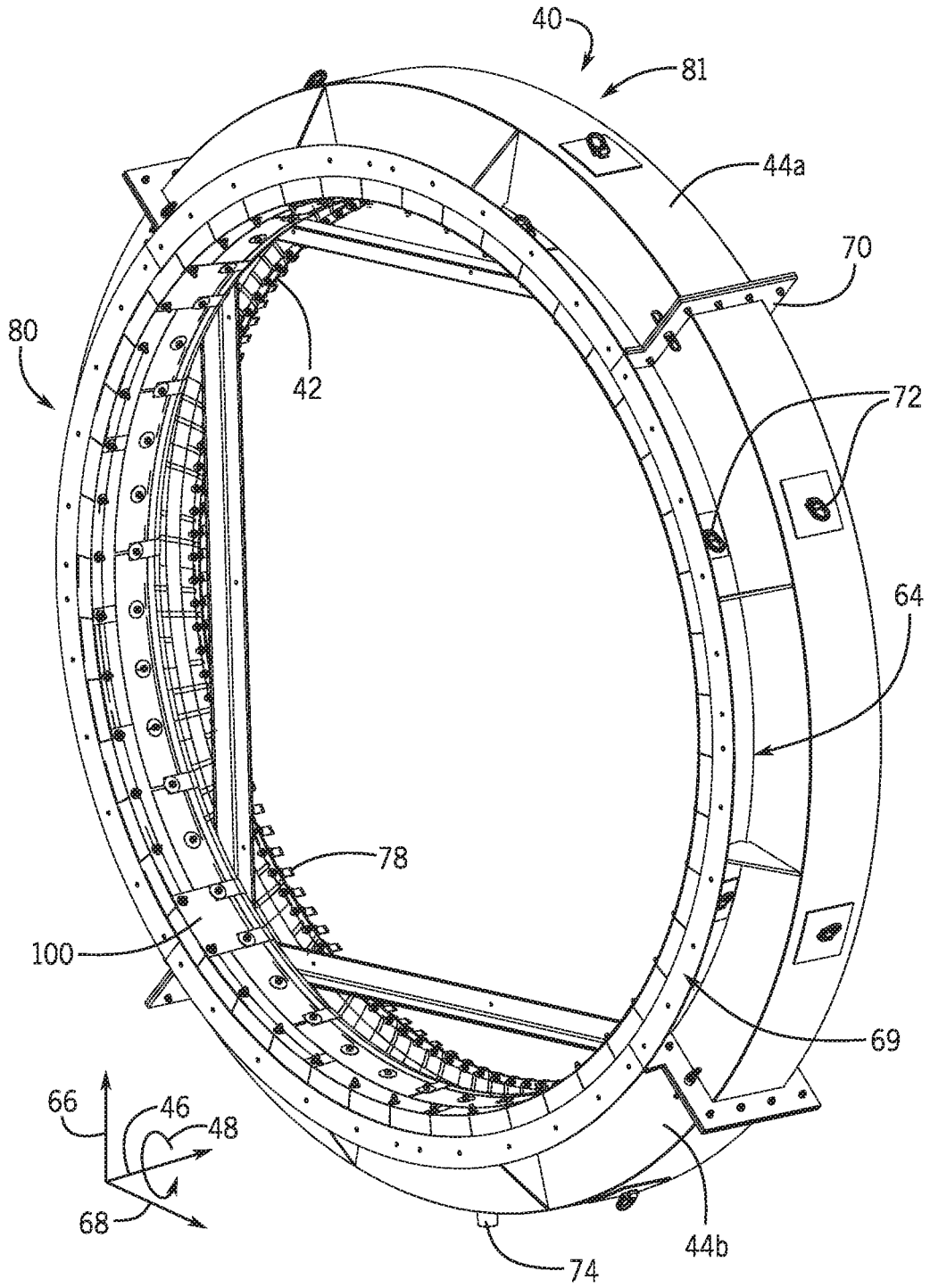
FIG. 4 is a rear perspective view of the embodiment of the flex seal assembly of FIG. 3.

The flex seal assembly 40 may be disposed about the outlet portion 55 of the turbine 18 and the inlet portion 50 of the diffuser 38 such that duct segments 44 of the flex seal assembly 40 extend around the joint 54. For instance, a front portion 62 of the duct segment 44 may be disposed in a circumferential direction 48 around the seal portion 60, and a rear portion 64 of the duct segment 44 may be disposed in the circumferential direction 48 around the neck portion 56 of the joint 54. The flex seal assembly 40 may also be coupled to, and disposed in the circumferential direction 48 around, the outlet portion 55 of the turbine 18. The flex seal assembly 40 may be coupled to the turbine 18 and/or to the diffuser 38 to keep the flex seal assembly 40 in place once disposed around the joint 54, the diffuser 38, and/or the turbine 18. For example, the geometry of the flex seal assembly 40 and the inlet portion 50 may aid in maintaining the placement of the flex seal assembly 40 about the diffuser 38. More specifically, the rear portion 64 may abut the seal portion 60 of the inlet portion 50, which may aid in maintaining an axial position of the flex seal assembly 40 along the joint 54 relative to the turbine 18 (e.g., along the axis 46). Furthermore, the rear portion 64 of the flex seal assembly 40 may be coupled to the diffuser 38 via fasteners which may extend through openings 69 of the rear portion 64 that are illustrated in FIG. 4. Coupling the rear portions 64 to the diffuser 38 reduces movement in directions other than an axial direction, such as in the circumferential direction 48, a vertical direction 66, and one or more lateral directions 68.

Figure 3:
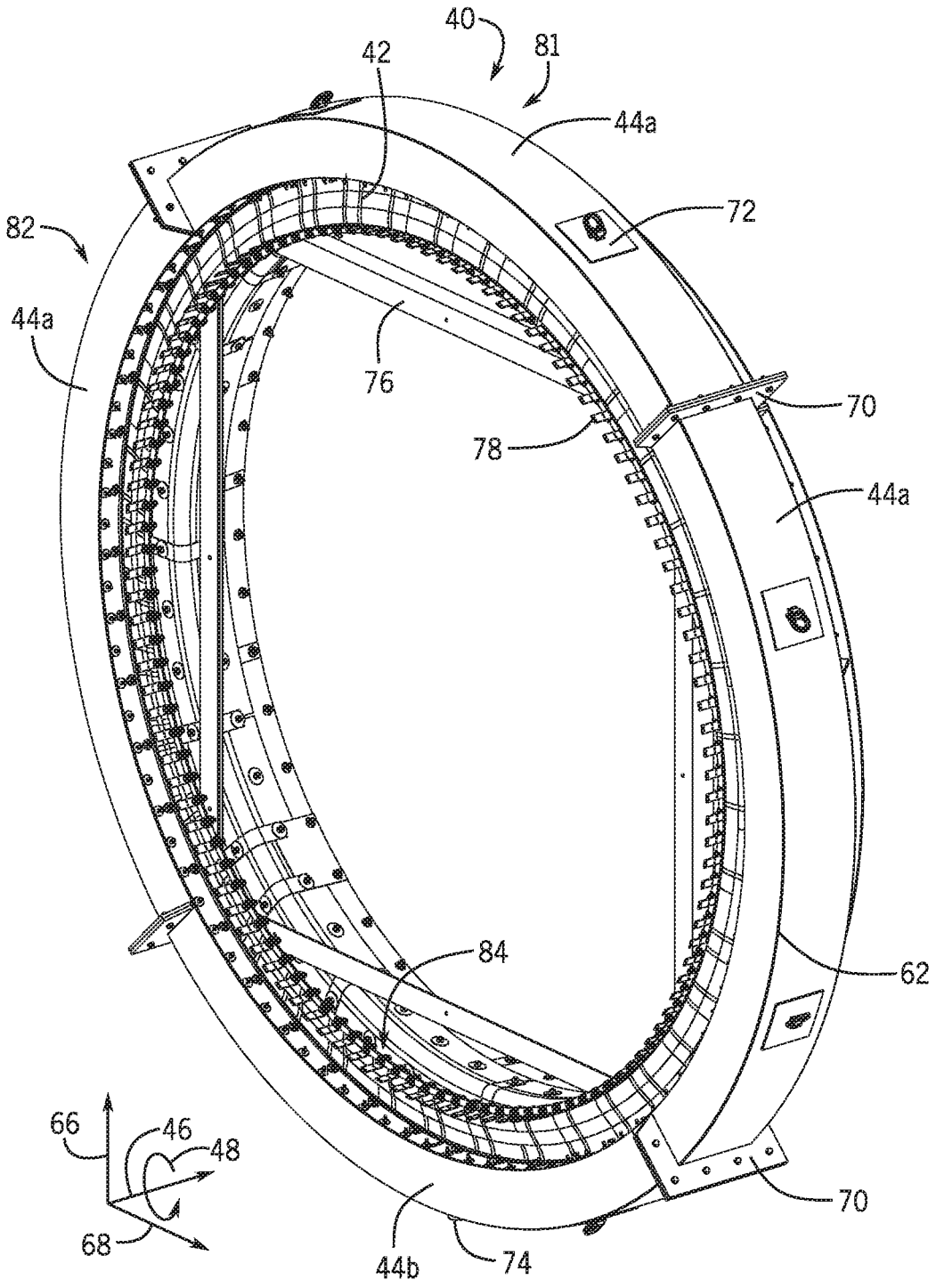
FIG. 3 is a front perspective view of an embodiment of the flex seal assembly of FIG. 1.

FIG. 3 depicts a front perspective view of an embodiment of the flex seal assembly 40 of the gas turbine system 10, and FIG. 4 depicts a rear perspective view of the embodiment of the flex seal assembly 40 of FIG. 3. To facilitate discussion of the flex seal assembly 40, FIG. 3 and FIG. 4 are discussed together below.

As illustrated, the flex seal assembly 40 includes four duct segments 44 that include flanges 70 that may be coupled to flanges 70 of adjacent duct segments 44 via fasteners such as bolts or screws. The duct segments 44 also include lifting lugs 72 that may be utilized during installation of the flex seal assembly 40. The lifting lugs 72 are configured to support the weight of each duct segment 44 during installation of the flex seal assembly 40. More specifically, the flex seal assembly 40 may be installed into the turbine system 10 after the turbine 18 and diffuser 38 have been manufactured. In other words, the flex seal assembly 40 may be retrofitted to an existing turbine system.

In the illustrated embodiment of the flex seal assembly 40, two types of duct segments 44 are shown. In particular, the duct segments 44*a* are a first type of duct segment, while the duct segment 44*b* is a second type of duct segment. Generally speaking, the first and second types of duct segments are of approximately the same shape and size but differ in placement (e.g. circumferential placement) within the flex seal assembly 40. The duct segment 44*b* includes a drain pipe 74 via which liquid (e.g., water) within the duct segments 44 may exit the flex seal assembly 40. Additionally, while the present embodiment includes four duct segments 44, a different number of duct segments 44 may be utilized in other embodiments. For example, two, three, four, five, six, or more total duct segments 44 may be utilized. In each of these embodiments, the size of the duct segments 44 may be modified so that a circumference of the coupled duct segments 44 is approximately equal to the circumference of the coupled duct segments 44 illustrated in FIG. 3 and FIG. 4 is maintained irrespective of the number of duct segments 44 included in the flex seal assembly 40. Moreover, in such embodiments, at least one duct segment 44*b* of the second type may be included. For instance, in an embodiment having two duct segments 44, one may be a duct segment 44*a* of the first type, and another may be a duct segment 44*b* of the second type. As another example, in an embodiment with six duct segments 44, five or less of the duct segments 44 may be duct segments 44*a* of the first type, and one or more of the duct segments 44 may be duct segments 44*b* of the second type.

The duct segments 44 facilitate retrofitting of the flex seal assembly 40 to the turbine system 10. In particular, the segmented nature of the duct segments 44 enables the duct segments 44 to be installed on an existing turbine system 10 without having to move the turbine 18. Likewise, the duct segments 44 can be installed about the diffuser 38 without moving the diffuser 38. In other words, the duct segments 44 may be installed around the joint 54 while the turbine 18 and diffuser 38 are coupled to one another. More specifically, the duct segments 44 may be coupled to the diffuser 38 via fasteners that extend through openings in the inlet portion 50 and the openings 69 of the duct segments 44.

As additionally illustrated, the duct segments 44 may include shipping braces 76. The shipping braces 76 are configured to provide structural support to the duct segments 44 during transport and/or during installation. In some embodiments, the shipping braces 76 may be removed before duct segments 44 are installed on the turbine system 10.

A flex seal 42, which may be surrounded in the circumferential direction 48 by the duct segments 44, includes tabs 78 that extend axially 46 from the flex seal 42 and may be utilized to couple the flex seal 42 to the turbine 18 of the turbine system 10. In particular, the tabs 78 may extend axially into the outlet portion 55 of the turbine 18 and exert a radial force against interior walls of the turbine outlet 55. Coupling or interfacing the flex seal 42 to the turbine 18 via the tabs 78 may enable the flex seal 42 to move (e.g., along an axial direction indicated by the axis 46, the vertical direction 66, and the lateral direction 68) based on movement of the turbine 18. For example, as described above, operation cycles of the turbine system 10 may cause thermal expansion and contraction of materials that are subjected to the high temperature environment of the turbine 18 and diffuser 38. Accordingly, the flex seal 42 may accommodate movement of the turbine 18 with regard to the diffuser 38. Moreover, when the flex seal 42 is coupled to the turbine 18 and the duct segments 44 have been installed, the duct segments 44 may surround a circumferential surface of a portion of the turbine 18 so as to enclose a space between the turbine 18 and the diffuser 38 through which exhaust gases 36 may be directed. As such, the flex seal 42 may be exposed to high temperatures and high pressures associated with the exhaust gases 36. For example, the temperature within the turbine 18 may be greater than 1200° F., 1500° F., or 2000° F. The flex seal 42 may be constructed from a heat and high pressure resistant material, such as nickel-chromium alloys, inco-alloy materials, or other suitable high-performance materials. Accordingly, while the flex seal 42 may thermally expand and contract as the flex seal 42 is subjected to the exhaust gases 36, the flex seal 42 may maintain its structural integrity while accommodating movement of the turbine 18 with regard to the diffuser 38 and providing a sealed connection between the turbine 18 and the diffuser 38.

The duct segments 44 include rear portions 64, which may form a rear portion 80 of a duct assembly 81 that surrounds the neck portion 56 of the inlet portion 50 in the circumferential direction 48. In other words, the duct segments 44, as illustrated, may be coupled to one another to form a duct assembly 81. More specifically, the rear portions 64 of the duct segments 44, when the duct segments 44 are coupled to one another to form the duct assembly 81, form the rear portion 80 of the duct assembly 81. The duct assembly 81 may also include a front portion 82 that is formed by the front portions 62 of the duct segments 44 when assembled to form the duct assembly 81. The rear portion 80 formed by the rear portions 64 has a circumference that is smaller than a circumference of a front portion 82 of the duct assembly 81 formed by the front portions 62 of the duct segments 44. That is, the rear portion 80 may include a characteristic dimension, such as a diameter or width, that is smaller than a similar characteristic dimension of the front portion 82. As illustrated, the duct segments 44 may be designed such that the front portion 82 and rear portion 80 surround portions of the turbine 18 and the diffuser 38 in the circumferential direction 48. For example, the front portion 82 may partially surround portions of both the turbine 18 and the diffuser 38, while the rear portion 80 may surround a portion of the diffuser 38.

Figure 5:
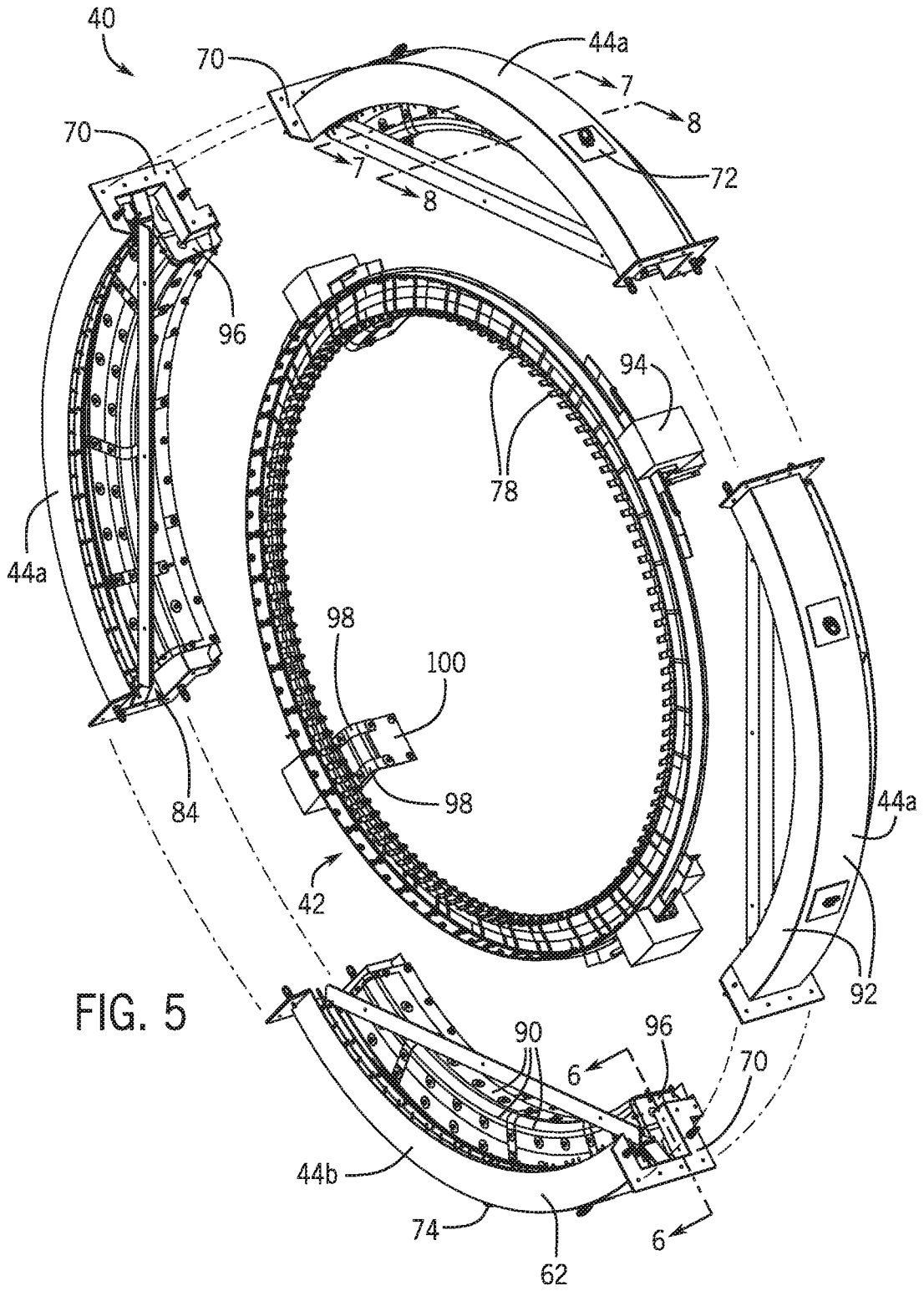
FIG. 5 is an assembly front perspective view of the embodiment of the flex seal assembly of FIG. 3.

The duct segments 44 may include several different components, and the duct segments 44 may each include a groove 84. When the duct segments 44 are coupled to form the rear portion 80 and the front portion 82, the grooves 84 of the respective duct segments 44 may be aligned to form a circumferential groove that extends in the circumferential direction 48 around an interior surface of the front portion 82 of the duct assembly 81. The flex seal 42 may be disposed within the circumferential groove 84. With this mind, FIG. 5 illustrates an assembly view of the flex seal assembly 40. As illustrated, the duct segment 44 includes liners 90 that may be made from stainless steel. The liners 90 may form an internal surface of each duct segment 44 that faces the interior of the front portion 82 and the rear portion 80 formed by the duct segments 44. In other words, the liners 90 may form internal walls of the duct segments 44. Additionally, the duct segment 44 may include exterior walls 92, which may be made from carbon steel. Insulation 94 may be included radially between exterior walls 92 and the liners 90. In particular, the insulation 94 may include several segments of insulation 94 that are spaced between scallop bars 96 of the duct segments 44. In other words, the scallop bars 96 and insulation 94 may be included within the duct segments 44. The liners 90 may encase the scallop bars 96 and insulation 94. In other words, the insulation 94 may be placed between scallop bars 96, and the liners 90 may be coupled to the scallop bars 96 (e.g., via fasteners) to cover the insulation 94. The scallop bars 96 may provide structural support for the enclosed shape formed by the liners 90, insulation 94, and scallop bars 96. In some embodiments, several layers of liners 90 may be utilized cover the insulation 94 and scallop bars 96.

Inclusion of the insulation 94 may enable the duct segments 44 to better withstand high temperature environments. For example, the insulation 94 insulates the exterior components of the flex seal assembly 40 from high temperatures associated with the exhaust gases 36 that pass from the turbine 18 to the diffuser 38. Accordingly, the insulation 94 enables a relatively higher temperature difference between the liners 90 and the exterior wall 92 of the flex seal assembly 40 when running the turbine system 10. The insulation 94 may reduce thermal stresses in the exterior wall 92 by reducing the cyclic temperature change of the exterior wall 92 during startup, operation, and shutdown of the turbine system 10.

Figure 6:
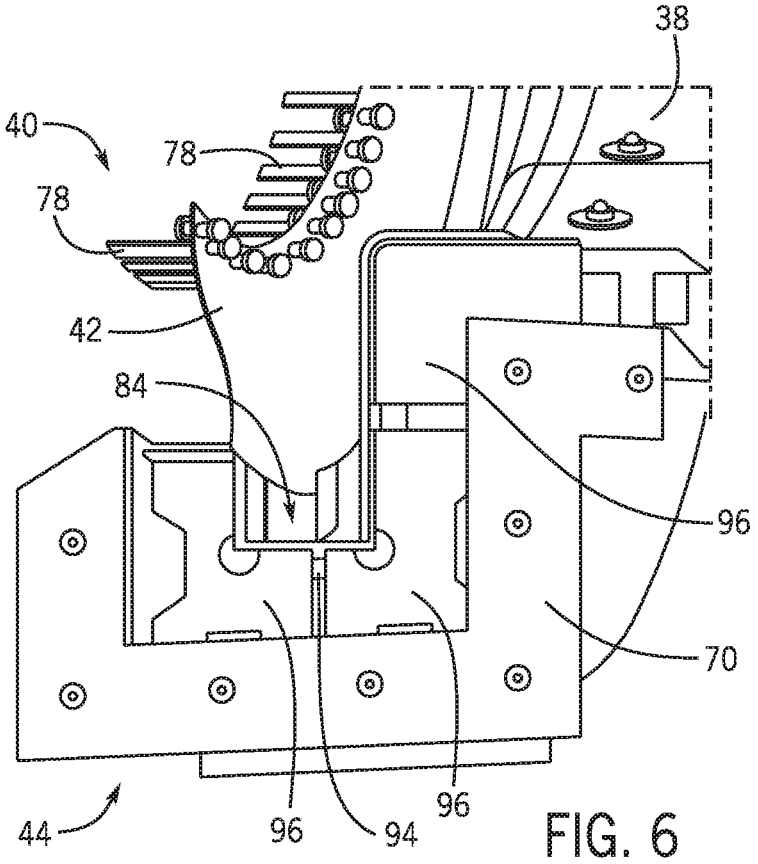
FIG. 6 is a cross-sectional view of an embodiment of a flex seal assembly and a portion of a diffuser section of a gas turbine.

To help illustrate more detail regarding the duct segments 44, FIG. 6 illustrates a cross-sectional view of the flex seal assembly 40. More particular, the view provided in FIG. 6 is generally of a view along line 6-6 of FIG. 5. However, it should be noted that some components of the flex seal assembly 40 are omitted in FIG. 6 to increase clarity.

As illustrated, scallop bars 96 are disposed within the flex seal assembly 40. The scallop bars 96 may be coupled to walls of the duct segments 44 via fasteners. As described above, the insulation 94 may be included between sets of scallop bars 96, which include scallop bars 96 that are generally arranged along axially-extending planes. For instance, in the illustrated embodiment, a set of three scallop bars 96 is generally aligned along a plane to form a "J" shape. Other sets of scallop bars 96 may be arranged circumferentially along the groove 84 of the duct segment 44. Furthermore, insulation 94 may be arranged circumferentially between two sets of scallop bars 96. Such a pattern (i.e., insulation 94 disposed circumferentially between sets of scallop bars 96) may repeat throughout a length of each duct segment 44. Furthermore, due to the "J" shape of the duct segment 44, the scallop bars 96 and the insulation 94 may extend radially into the groove 84 that extends the circumferential length of the duct segment 44.

Additionally, FIG. 6 illustrates the placement of the flex seal 42. In particular, the flex seal 42 may be positioned generally flush with a surface of the inlet portion 50 of the diffuser 38. Accordingly, the flex seal 42 may form a seal between the turbine 18 and the diffuser 38 that enables exhaust gases 36 to be retained within the circuit formed by the turbine 18, flex seal assembly 40, and diffuser 38.

Figure 7:
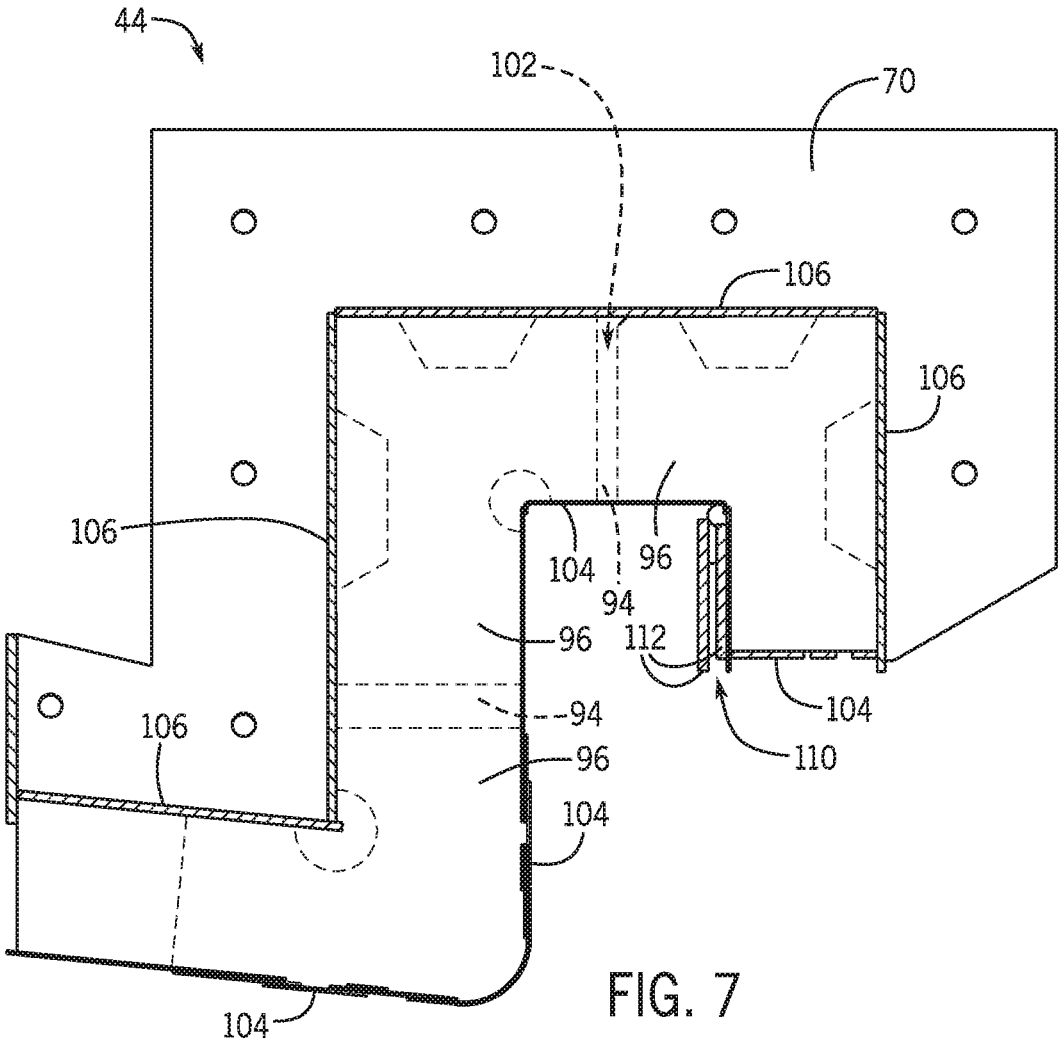
FIG. 7 is a cross-sectional view of the embodiment of the duct portion of FIG. 5.
Figure 8:
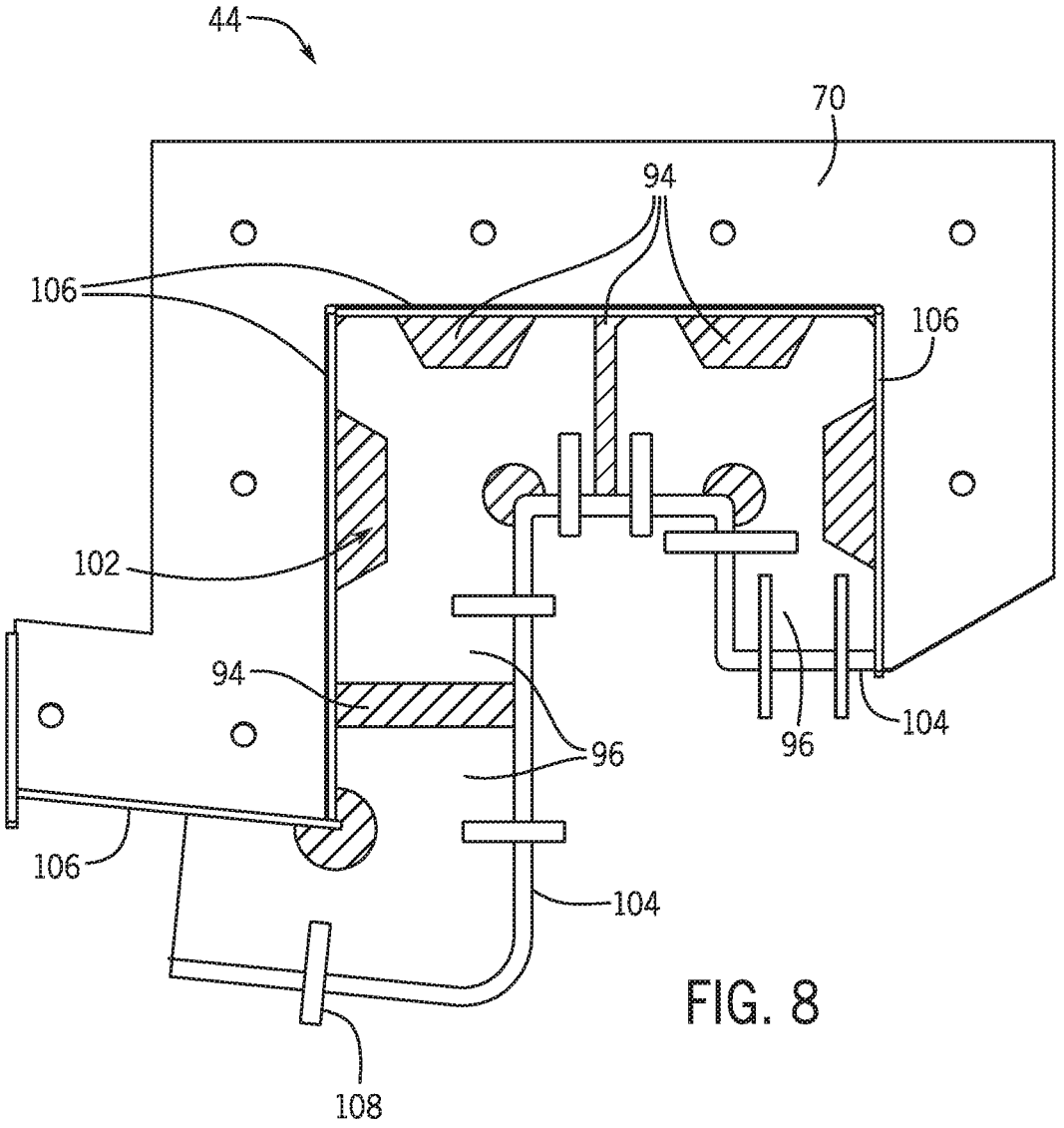
FIG. 8 is an additional cross-sectional view of the embodiment of the duct portion of FIG. 5.

To further illustrate features of the duct portions 44, FIG. 7 illustrates a cross-sectional view of the duct portion 44 along line 7-7 of FIG. 5. To increase clarity, the scallop bars 96 are illustrated in phantom. As illustrated, insulation 94 and scallop bars 96 may be disposed within an interior 102 of the duct portion 44 that is defined as a space within an interior wall 104 and exterior wall 106 of the duct portion 44. The interior wall 104 and exterior wall 106 may be formed from several liners 90. As shown in FIG. 7, the insulation 96 may be disposed behind scallop bars 96. The insulation 94 may also be disposed in front of other scallop bars 96 that are disposed within the duct portion 44. For instance, FIG. 8 illustrates a different circumferential cross-section than FIG. 7. In FIG. 8, a set of three scallop bars 96 are shown within the interior 102 of the duct segment 44. As discussed above, each set of the scallop bars 96 may be circumferentially spaced within the interior 102 of the duct segment 44, with insulation disposed between sets of scallop bars 96.

FIG. 8 also illustrates that the scallop bars 96 may be coupled to the liners 90 of the interior wall 104 via fasteners 108. The scallop bars 96 may also abut and/or couple to an interior side of the exterior wall 106 (e.g., portions of the exterior wall 106 that face the interior 102). Arranging the scallop bars 96 in the interior 102 of the duct portion 44 with the insulation 94 therebetween provides the duct portions 44 with radial support around the circumference of the flex seal assembly 40.

Continuing the discussion related to the flex seal 42, and referring back to FIG. 5, the flex seal 42 may be coupled to the duct segments 44 via fasteners that extend through openings in brackets 98 and a plate 100. In particular, one end of the brackets 98 may couple to the flex seal 42 via fasteners. The brackets 98 can generally extend radially inwards, and another end of the brackets 98 may be coupled to the plate 100 (e.g., via fasteners). The plate 100 may also be coupled to the rear portion 64 of the duct segments 44, as illustrated in FIG. 4. Referring to FIG. 7, a receiving member 112 (e.g., lip) of the liner 90 may be configured to receive a portion of the flex seal 42 within an opening 110 (e.g., groove, pocket). Moreover, the flex seal 42 may be coupled to the duct portion 44 via a fastener that extends through the receiving member 112, the opening 110, the flex seal 42, and one or more liners 90 that form the interior wall 104. As such, the flex seal 42 may be coupled to upstream end of the duct segments 44 proximate the turbine 18 as well as to a downstream end of the duct segments proximate the diffuser 38.

Figure 9:
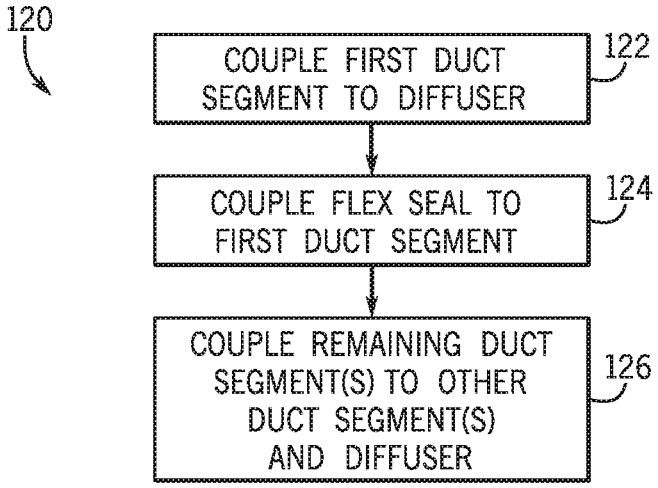
FIG. 9 is a flowchart of an embodiment of a method for installing a flex seal assembly onto a diffuser section of a gas turbine system.

Continuing with the drawings, FIG. 9 illustrates a flowchart of a process 120 for installing a retrofittable flex seal assembly in a turbine system. For example, the process 120 can be performed to install the flex seal assembly 40 within the turbine system 10. Furthermore, it should be noted that while the process 120 is described below in one order, the process 120 may be performed in different orders in other embodiments.

At process block 122, a first duct segment 44 may be placed about and coupled to the diffuser 38. As noted above, the duct segments 44 may be coupled to the diffuser 38 via fasteners that extend through the rear portion 64 of the duct segments 44. Furthermore, it should be noted that the first duct segment 44 may be a duct segment 44 of the first type (e.g., duct segment 44*a*) or a duct segment of the second type (e.g., duct segment 44*b*).

At process block 124, the flex seal 42 may be placed against the diffuser 38 (e.g., abutting the inlet portion 50 of the diffuser 38) and coupled to the first duct segment 44. For instance, the first duct segment 44 and the flex seal 42 may be coupled to one another via fasteners that extend through the bracket 98 and plate 100 as described above.

At process block 126, any remaining duct segments 44 may be coupled to the first duct segment 44 or other duct segments 44 of the remaining duct segments 44, and the remaining duct segments 44 may also be coupled to the diffuser 38. For instance, the duct segments 44 may be placed to circumferentially surround the flex seal 42 and coupled to one another via fasteners that extend through the flanges 70 of the duct segments 44. Additionally, the flex seal 42 may be coupled to the remaining duct segments 44 via fasteners that extend through the brackets 98 and plates 100 associated with the remaining duct segments 44. Moreover, the remaining duct segments 44 may be coupled to the diffuser 38 via fasteners that extend through the rear portions 64 of the duct segments 44 into the diffuser 38.

Furthermore, when installed, the duct segments 44 form the front portion 82 of the duct assembly 81 that extends circumferentially around the diffuser 38 and the turbine 18. As noted above, and depending on the embodiment of the flex seal assembly 40, varying numbers of duct segments 44 may be used. Accordingly, the process 120 may be modified based on the embodiment of the flex seal assembly 40. For example, in embodiments of the flex seal assembly 40 having more than two duct segments 44, more than one duct segment 44 may be coupled to the diffuser 38 at process block 122, which may occur before the flex seal 42 is installed. Additionally, it should be noted that in some embodiments of the process 120, the flex seal 42 may be coupled to the diffuser 38 before any duct segments 44 are installed.

Technical effects of the present disclosure include retrofittable flex seal assembly that may be installed into a turbine system after the turbine system has been manufactured. Additionally, the flex seal assembly provides a connection between an outlet of a turbine and an inlet of a diffuser that accommodates axial movement between the turbine and the diffuser while maintaining isolation of hot, pressurized exhaust gases within the turbine from the ambient environment. The flex seal assembly also includes a drain that is configured to enable liquid (e.g., water) that forms in the flex seal assembly to be expelled. Furthermore, the flex seal assembly includes insulation that enables portions of the flex seal assembly that are exposed to ambient conditions outside the flex seal assembly to be better insulated from the high temperatures of the exhaust gases within the turbine and diffuser.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A flex seal assembly comprising:

a plurality of duct segments configured to be disposed about a joint between a turbine of a turbine system and a diffuser of the turbine system, wherein the plurality of duct segments comprises a groove configured to extend circumferentially around the joint, wherein the plurality of duct segments comprises:

a first duct segment;

a second duct segment, wherein the second duct segment comprises a drain; and a plurality of segments of insulation disposed within the groove of the plurality of duct segments;

a flex seal configured to be coupled to the plurality of duct segments and at least partially disposed within the groove of the plurality of duct segments, wherein the flex seal is configured to:

extend across the joint between the turbine and the diffuser of the turbine system; and accommodate axial movement of the turbine relative to the diffuser; and a plate and one or more brackets configured to couple the flex seal to at least one of the plurality of duct segments, wherein the plate is configured to be directly coupled to the one or more brackets, and the one or more brackets are configured to be directly coupled to at least one of the plurality of duct segments.

2. The flex seal assembly of claim 1, wherein the plurality of duct segments comprises a third duct segment, wherein a first circumferential end of the second duct segment is configured to couple with the first duct segment, and a second circumferential end of the second duct segment is configured to couple with the third duct segment.

3. The flex seal assembly of claim 2, wherein the first duct segment of the plurality of duct segments and the third duct segment of the plurality of duct segments are of a first type of duct segment without the drain.

4. The flex seal assembly of claim 1, wherein the plurality of duct segments comprises four or more duct segments.

5. The flex seal assembly of claim 1, wherein each duct segment of the plurality of duct segments comprises a first flange and a second flange, wherein the first flange of each duct segment is configured to abut the second flange of an adjacent duct segment of the plurality of duct segments, wherein the plurality of duct segments is configured to circumferentially enclose the joint between the turbine and the diffuser of the turbine system.

6. The flex seal assembly of claim 1, wherein each duct segment of the plurality of duct segments comprises a plurality of sets of scallop bars, wherein each set of scallop bars of the plurality of sets of scallop bars is configured to be coupled to one or more liners that encase a portion of the plurality of segments of insulation disposed between sets of scallop bars of the plurality of sets of scallop bars.

7. The flex seal assembly of claim 1, comprising:

a plurality of fasteners, wherein each duct segment of the plurality of duct segments comprises a rear portion comprising a plurality of openings, wherein each opening of the plurality of openings is configured to receive a respective fastener of the plurality of fasteners to couple the respective duct segments to the diffuser; and wherein the plurality of duct segments forms a duct assembly having a rear width of the rear portion of the duct assembly that is less than a front width of a front portion of the duct assembly.

8. A system, comprising:

a turbine;

a diffuser configured to receive an airflow from the turbine;

a flex seal assembly separate from the turbine and the diffuser, wherein the flex seal assembly comprises a plurality of duct segments configured to be disposed about a joint between the turbine and the diffuser, wherein the plurality of duct segments is configured to enclose the joint and at least an end portion of the turbine, wherein the plurality of duct segments comprises:

a first duct segment of the plurality of duct segments;

a second duct segment of the plurality of duct segments, wherein the second duct segment comprises a drain; and insulation disposed within each of the plurality of duct segments; and a plate and one or more brackets configured to couple the flex seal to at least one of the plurality of duct segments, wherein the plate is configured to be directly coupled to the one or more brackets, and the one or more brackets are configured to be directly coupled to at least one of the plurality of duct segments.

9. The system of claim 8, comprising a flex seal, wherein the flex seal comprises an inco-alloy material.

10. The system of claim 9, comprising a plurality of clips configured to couple the flex seal to the turbine.

11. The system of claim 8, wherein the plate is configured to be directly coupled to a rear portion of a duct assembly formed by coupling the plurality of duct segments together, wherein the rear portion of the duct assembly is configured to be coupled to the joint via a plurality of fasteners.

12. The system of claim 8, wherein each of the plurality of duct segments comprises at least one lifting lug configured to support the respective duct segment during an installation of the duct segment.

13. The system of claim 8, wherein each of the plurality of duct segments comprises segments of insulation that are disposed between sets of scallop bars included within each of the plurality of duct segments.

14. A method, comprising:

arranging a plurality of duct segments around a joint of a turbine system between a turbine and a diffuser of the turbine system, wherein the plurality of duct segments is separate from the turbine and the diffuser, wherein a first duct segment of the plurality of duct segments is arranged proximate to a bottom of the joint, wherein the first duct segment comprises a drain and is different than other duct segments of the plurality of duct segments;

removably coupling the first duct segment of the plurality of duct segments to the diffuser of the turbine system proximate to the bottom of the joint;

directly coupling one or more brackets to at least one of the plurality of duct segments, wherein a plate is directly coupled to the one or more brackets;

coupling a flex seal to the plurality of duct segments using the plate and the one or more brackets; and removably coupling the other duct segments of the plurality of duct segments to the diffuser and the first duct segment of the plurality duct segments.

15. The method of claim 14, comprising installing a plurality of segments of insulation within a groove of the plurality of duct segments around the joint.

16. The method of claim 14, comprising coupling the flex seal to the diffuser.

17. The method of claim 14, wherein the other duct segments of the plurality of duct segments comprises at least two duct segments.

18. The system of claim 9, wherein:

the flex seal is configured to be disposed within a groove formed by an outer surface of a plurality of inner walls of the plurality of duct segments;

the insulation is disposed against an inner surface of the plurality of inner walls of the plurality of duct segments;

the insulation extends at least partially into a rear portion and a front portion of a duct assembly formed by coupling the plurality of duct segments together; and the rear portion of the duct assembly has a first circumference that is different than a second circumference of the front portion of the duct assembly.

* * * * *